US010458693B2

(12) United States Patent
Jeong et al.

(10) Patent No.: US 10,458,693 B2
(45) Date of Patent: Oct. 29, 2019

(54) REFRIGERATOR

(71) Applicant: SAMSUNG ELECTRONICS CO., LTD., Suwon-si, Gyeonggi-do (KR)

(72) Inventors: Jin Jeong, Yongin-si (KR); Jae Jin Lee, Suwon-si (KR); Seok Jun Yoon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/646,781

(22) Filed: Jul. 11, 2017

(65) Prior Publication Data

US 2018/0017310 A1 Jan. 18, 2018

(30) Foreign Application Priority Data

Jul. 13, 2016 (KR) ..... 10-2016-0088473

(51) Int. Cl.
*F25C 5/20* (2018.01)
*F25C 5/04* (2006.01)
*F25D 23/04* (2006.01)

(52) U.S. Cl.
CPC ..... *F25C 5/22* (2018.01); *F25C 5/046* (2013.01); *F25D 23/04* (2013.01); *F25C 2400/10* (2013.01); *F25D 2500/02* (2013.01)

(58) Field of Classification Search
CPC .. F25C 5/22; F25C 5/005; F25C 5/046; F25C 2400/10; F25C 5/12; F25C 5/14; F25D 23/04; F25D 2500/02
See application file for complete search history.

(56) References Cited

U.S. PATENT DOCUMENTS

2006/0059939 A1 3/2006 An et al.
2006/0086127 A1* 4/2006 Anselmino ..... F25C 5/22 62/340
2006/0090496 A1* 5/2006 Adamski ..... F25D 11/02 62/344
2006/0201189 A1 9/2006 Adamski et al.
2008/0263963 A1* 10/2008 Lee ..... F25D 23/087 49/475.1
2010/0257889 A1 10/2010 Lee
(Continued)

FOREIGN PATENT DOCUMENTS

CN 1752676 3/2006
CN 102388280 3/2012
(Continued)

OTHER PUBLICATIONS

Australian Office Action dated Apr. 30, 2018 in Australian Patent Application No. 2017204781.
(Continued)

*Primary Examiner* — Emmanuel E Duke
(74) *Attorney, Agent, or Firm* — Staas & Halsey LLP

(57) ABSTRACT

A refrigerator includes a main body, a door rotatably coupled to the main body, a first ice making compartment configured to generate and store ice and provided in the main body, a second ice making compartment configured to crush ice and provided in the door, and a transfer device provided to transfer the ice in the first ice making compartment to the second ice making compartment. Therefore, a structure of an ice bucket storing ice is simplified, and an ice making system is easily constructed.

13 Claims, 12 Drawing Sheets

(56) References Cited

U.S. PATENT DOCUMENTS

| | | | | |
|---|---|---|---|---|
| 2011/0067430 | A1 | 3/2011 | Martin et al. | |
| 2012/0031136 | A1* | 2/2012 | Park | F25D 11/02 62/340 |
| 2012/0324937 | A1 | 12/2012 | Adamski et al. | |
| 2013/0327082 | A1* | 12/2013 | Son | F25C 1/00 62/344 |
| 2014/0345313 | A1* | 11/2014 | Jeong | F25C 5/046 62/320 |
| 2015/0061484 | A1* | 3/2015 | Jeong | F25C 5/182 312/404 |

FOREIGN PATENT DOCUMENTS

| | | |
|---|---|---|
| CN | 103486811 | 1/2014 |
| CN | 104422229 | 3/2015 |
| EP | 2674702 | 12/2013 |
| EP | 2808627 | 12/2014 |
| KR | 10-2011-0081704 | 7/2011 |
| WO | WO 2006/107180 | 10/2006 |
| WO | WO 2010/123177 A1 | 10/2010 |

OTHER PUBLICATIONS

Extended European Search Report dated Oct. 12, 2017 in European Patent Application No. 17180787.8.

Australian Patent Office issued search report Notice of acceptance for patent application (Decision on Grant) dated Aug. 17, 2018 in corresponding Australian Patent Application No. 2017204781 (total 3 pages).

European Patent Office issued Communication pursuant to Article 94(3) EPC in European Patent Application No. 17180787.8 dated Feb. 13, 2019 (7 total pages).

Chinese Office Action dated May 29, 2019 in corresponding Chinese Patent Application No. 201710572106.2.

* cited by examiner

REFRIGERATOR

CROSS-REFERENCE TO RELATED APPLICATIONS

This application claims the priority benefit of Korean Patent Application No. 10-2016-0088473, filed on Jul. 13, 2016 in the Korean Intellectual Property Office, the disclosure of which is incorporated herein by reference in its entirety.

BACKGROUND

1. Field

Embodiments of the disclosure relate to a refrigerator having an ice making system for generating, storing and crushing ice.

2. Description of the Related Art

A refrigerator has a main body in which a storage compartment is formed, and a cold air supply device for supplying cold air to the storage compartment, thereby storing food freshly.

Refrigerators may be equipped with automatic ice making system. The automatic ice making system performs a series of processes for supplying water to an ice making tray, cooling water in the ice making tray, releasing ice from the ice making tray, storing ice in an ice bucket, and transferring ice to a dispenser.

Generally, in a bottom mounted freezer (BMF) type refrigerator in which a freezing compartment is provided at a lower portion of a main body and a refrigerating compartment is provided at an upper portion thereof, an ice making compartment is provided at an upper portion of the main body so as to be separated from the refrigerating compartment, and accessories for automatic ice making are placed in the ice making compartment.

The refrigerator has a storage compartment door coupled to the main body for opening and closing the storage compartment, and an ice making compartment door for opening and closing the ice making compartment. Generally, the ice making compartment door is provided integrally with the ice bucket.

SUMMARY

Additional aspects and/or advantages will be set forth in part in the description which follows and, in part, will be apparent from the description, or may be learned by practice of the disclosure.

It is an aspect of the disclosure to disclose a refrigerator in which the structure of an ice bucket is simplified and the constructing of the ice making system is facilitated.

In accordance with an aspect of the disclosure, a refrigerator may include a main body, a door rotatably coupled to the main body, a first ice making compartment configured to generate and store ice, and provided in the main body, a second ice making compartment configured to crush the ice, and provided in the door, and a transfer device provided to transfer the ice in the first ice making compartment to the second ice making compartment.

When the door is closed, the first ice making compartment and the second ice making compartment may communicate with each other.

The door may include a sealing member which is provided to seal between the first ice making compartment and second ice making compartment.

The refrigerator may further include a storage compartment provided in the main body, and the door may include a door body part provided to open and close the storage compartment and a second ice making housing in which the second ice making compartment is formed.

The second ice making housing may be protruded from the door body part to the inside of the main body when the door is closed.

The door body part and the second ice making housing may be separately provided and coupled to each other.

The door may include a fixer member for coupling the door body part and the second ice making housing.

The door body part may include a heat insulation, and the fixer member may be supported and fixed by the heat insulation.

The door body part and the second ice making housing may be integrally formed.

The second ice making housing may include a heat insulation provided to heat the second ice making compartment.

The refrigerator may further include a first ice making housing coupled to the body to form the first ice making compartment, and the first ice making compartment may include a housing upper wall forming an upper surface of the first ice making compartment, a lower housing wall forming a lower surface of the first ice making compartment, and a housing sidewall forming any one of the side surfaces of the first ice making compartment.

The refrigerator may further include an ice making tray provided to store water to produce the ice, and an ice bucket provided to store the ice, and the ice making tray and the ice bucket may be disposed in the first ice making compartment.

The ice bucket may include a bottom and at least one sidewall extending upwardly from the bottom to form an ice storage space, and a sidewall adjacent to the second ice making compartment when the door is closed of the at least one sidewall may include an ice hole through which ice of the ice bucket is discharged.

The refrigerator may further include a crushing device provided to crush the ice, and the crushing device may be disposed in the second ice making compartment.

The crushing device may include a fixed blade, a rotating blade rotatably provided to crush the ice with the fixed blade, and a crushing motor for providing rotational force to the rotating blade.

In accordance with another aspect of the disclosure, a refrigerator may include a main body, a door rotatably coupled to the main body, a storage compartment provided in the main body to store food, and an ice making compartment provided in the main body to be partitioned from the storage compartment, and the door closes the ice making compartment when the door closes the storage compartment and the door opens the ice making compartment when the door opens the storage compartment.

The door may include a door body part provided to open and close the storage compartment and an ice making compartment door part provided to open and close the ice making compartment.

The ice making compartment door part may be provided to protrude from the door body part to the inside of the main body when the door is closed.

The door may include a first sealing member provided on the door body part to seal the storage compartment and a second sealing member provided on the ice making compartment to seal the ice making compartment.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
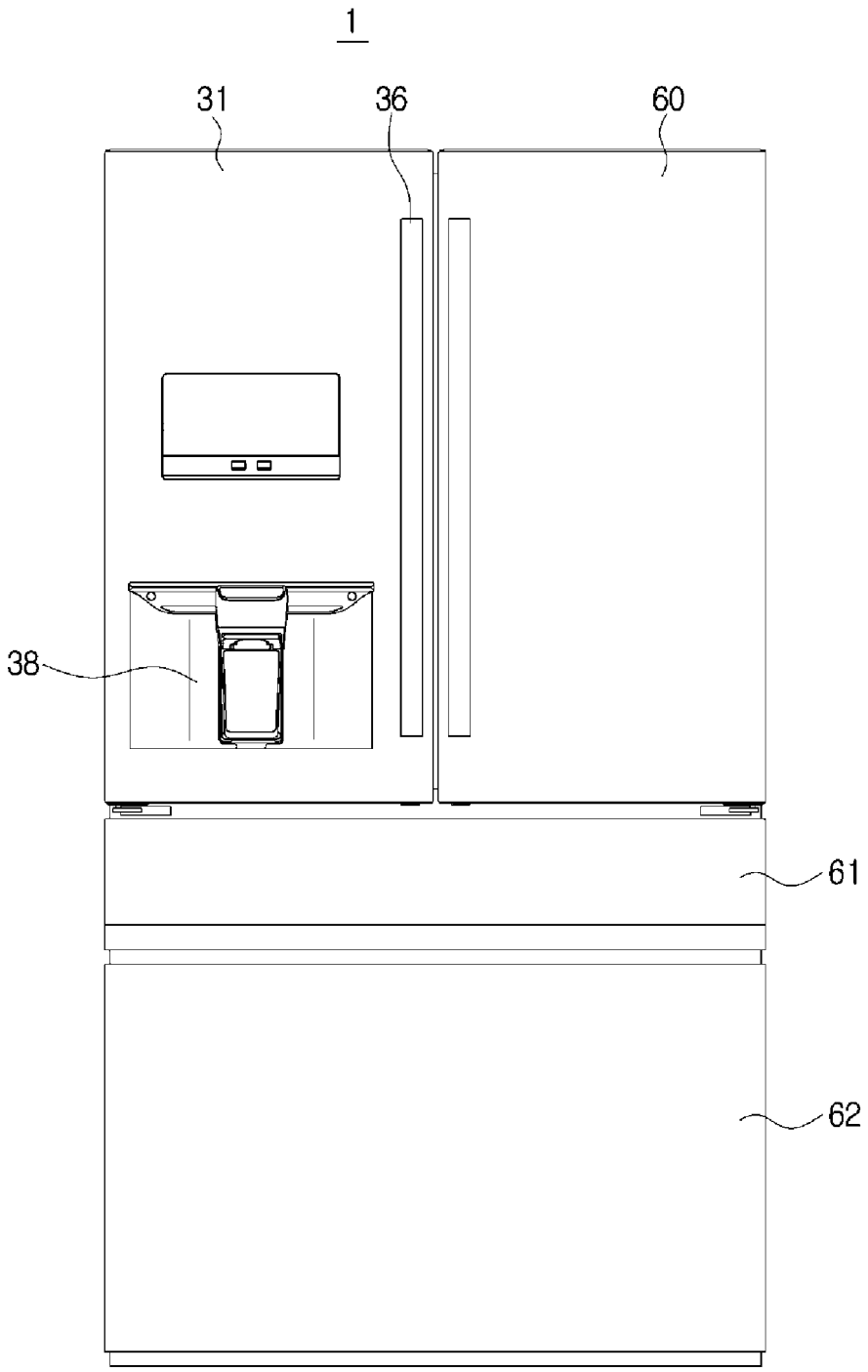
FIG. 1 is a front view illustrating a refrigerator according to an embodiment of the disclosure.

The embodiments described herein are merely example embodiments of the disclosure and are not intended to represent all of the technical ideas of the disclosure, so it should be understood that various equivalents or modifications that may be substituted for the same at the time of filing of the application are also included in the scope of the disclosure.

Reference will now be made in detail to the embodiments of the disclosure, examples of which are illustrated in the accompanying drawings, wherein like reference numerals refer to like elements throughout.

Figure 2:
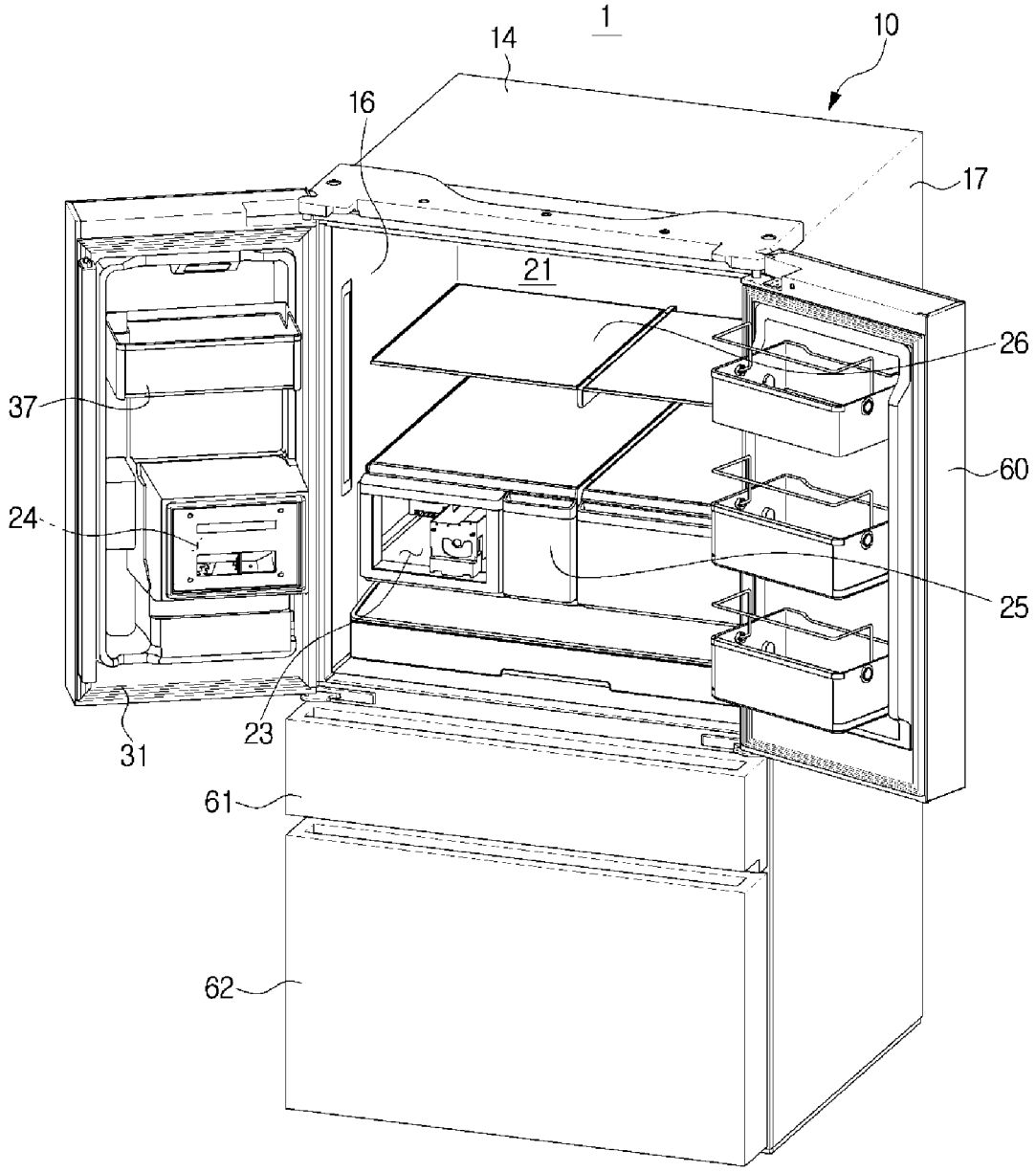
FIG. 2 is a view illustrating a state in which a door of the refrigerator of FIG. 1 is opened.
Figure 3:
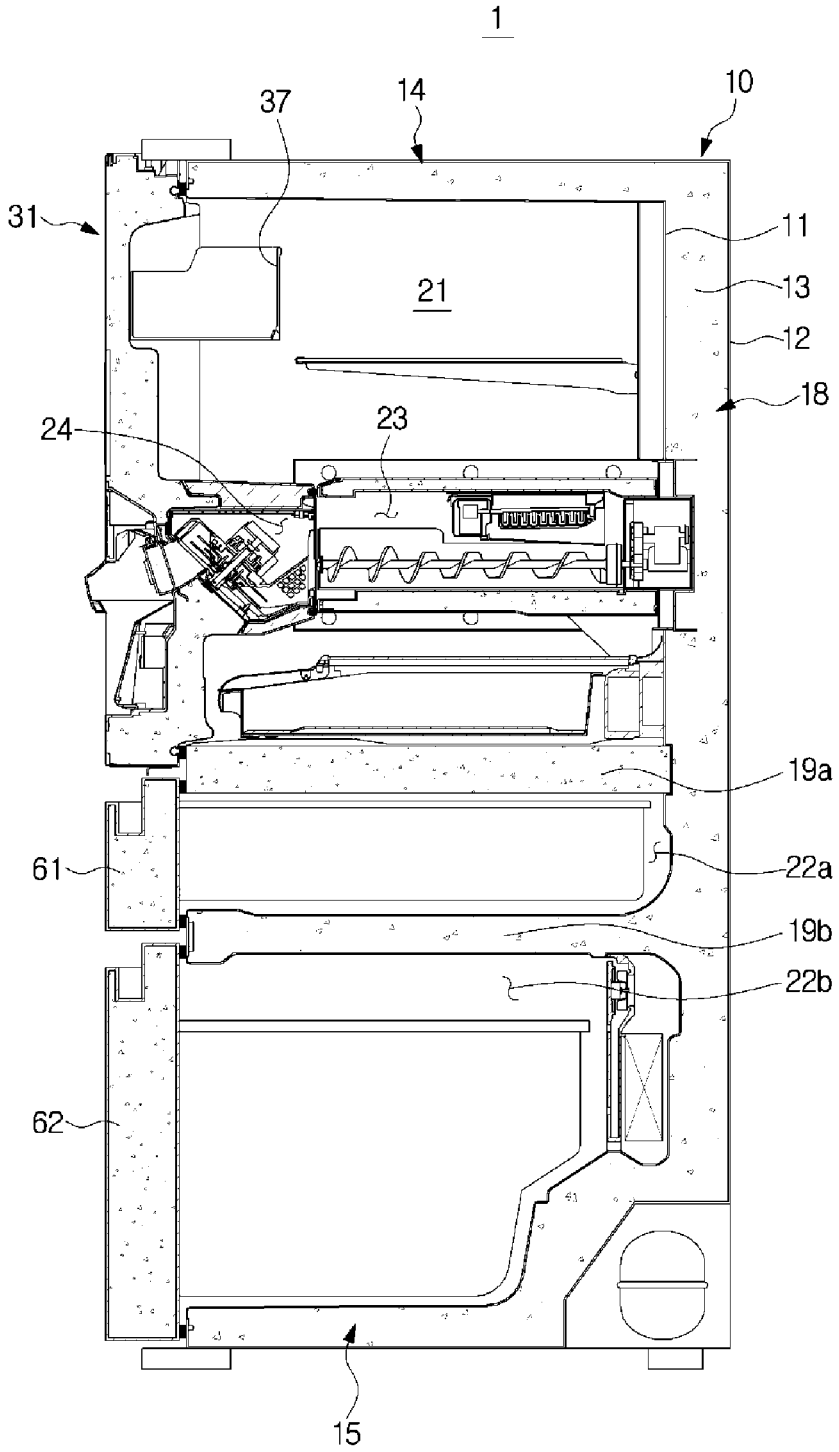
FIG. 3 is a side cross-sectional view schematically illustrating a main part of the refrigerator of FIG. 1.

FIG. 1 is a front view illustrating a refrigerator according to an embodiment of the disclosure. FIG. 2 is a view illustrating a state in which a door of the refrigerator of FIG. 1 is opened. FIG. 3 is a side cross-sectional view schematically illustrating a main configuration of the refrigerator of FIG. 1.

Referring to FIGS. 1 to 3, a refrigerator according to an embodiment of the disclosure will be described in detail. The refrigerator 1 may include a main body 10, storage compartments 21, 22*a* and 22*b* formed inside the main body 10 to store food therein, and cold air supply devices (not shown) for supplying cold air to the storage compartments 21, 22*a* and 22*b*, and doors 31, 60, 61 and 62 for opening and closing the storage compartments 21, 22*a* and 22*b*.

The main body 10 has a substantially box shape and is provided to have a front surface thereof opened. The main body 10 may include an inner case 11, an outer case 12 coupled to the outer side of the inner case 11, and a heat insulation 13 provided between the inner case 11 and the outer case 12.

The inner case 11 may be formed by injection molding with resin. The above-described storage compartments 21, 22*a* and 22*b* may be formed inside the inner casing 11. The outer case 12 may be formed of metal. The heat insulation 13 may include an urethane foam insulation or a vacuum insulation panel.

The urethane foam heat insulation may be formed by filling and foaming a urethane solution obtained by mixing urethane and a foaming agent in between the inner case 11 and the outer case 12 coupled to each other. The foamed urethane has a strong adhesive force to strengthen the bonding force between the inner and outer cases 11 and 12, and may have sufficient strength when the foaming is completed.

In another aspect, the body 10 may include an upper wall 14, a lower wall 15, a first sidewall 16, a second sidewall 17, a rear wall 18, intermediate walls 19*a* and 19*b*. The intermediate walls 19*a* and 19*b* may divide the inner case of the main body 10 into upper and lower portions.

The storage compartments 21, 22*a* and 22*b* may include a refrigerating compartment 21 formed at an upper portion of the main body 10 and freezing compartments 22*a* and 22*b* formed at a lower portion of the main body 10. The refrigerating compartment 30 may be maintained at about 0 to 5 degrees Celsius, so that the food may be refrigerated. The freezing compartments 22*a* and 22*b* may be maintained at about 0 to minus 30 degrees Celsius, so that the food may be stored in a frozen state. The storage room 21, 22*a*, and 22*b* may be provided with a shelf 26 on which food may be placed and a container 25 capable of containing food.

The cold air supply device may generate cold air by using latent heat of evaporation of a refrigerant and supply the cold air to the storage compartments 21, 22*a* and 22*b*. The cold air supply device may include a compressor, a condenser, an expansion device, an evaporator, and a blowing fan.

The refrigerating compartment 21 may be opened and closed by a pair of doors 31 and 60. The pair of doors 31 and 60 may be rotatably provided on the main body 10 through a hinge member and opened using a handle 36 for example. The freezing compartments 22*a* and 22*b* may be opened and closed by drawer-type doors 61 and 62 slidably provided in the main body 10. The door 31 may be provided with a door guard 37 for storing food and a dispenser 38 for providing water or ice. The user may be supplied with water or ice through the dispenser 38 without opening the door 31.

The refrigerator 1 may further include a first ice making compartment 23 configured to generate and store ice and a second ice making compartment 24 configured to crush ice. The first ice making compartment 23 may be provided in the main body 10 and the second ice making compartment 24 may be provided in the door 31.

Figure 4:
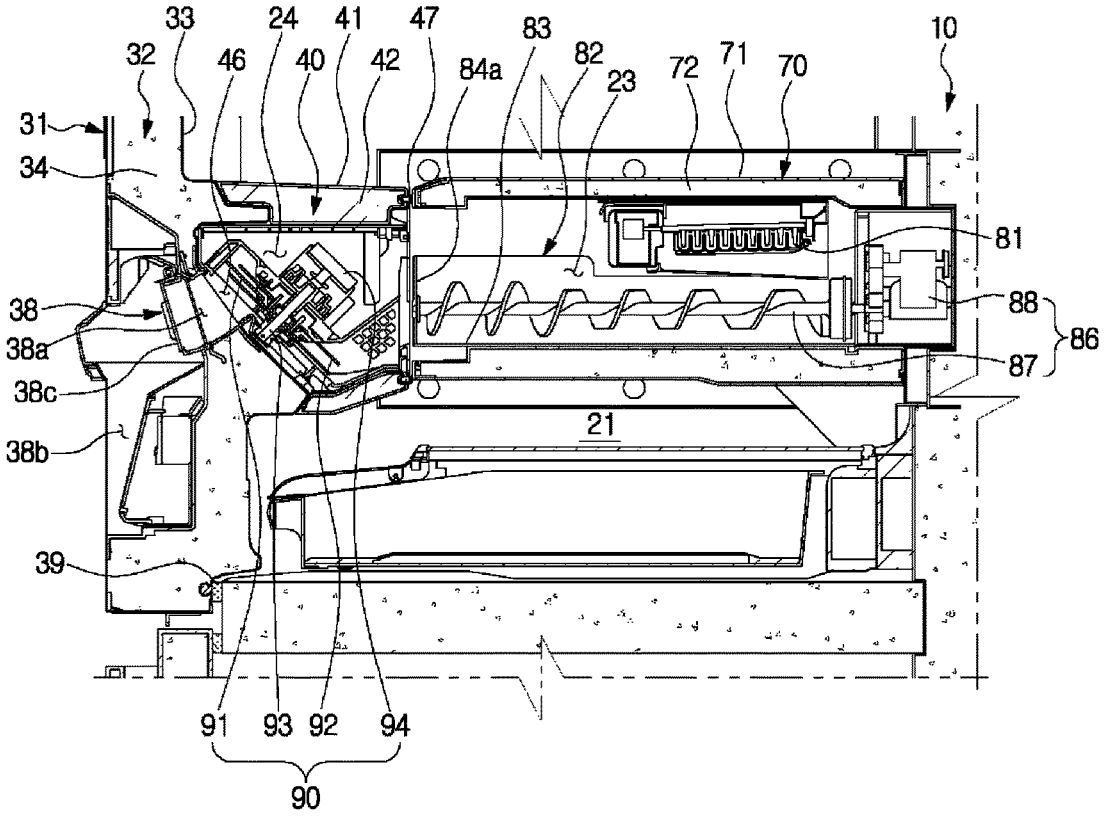
FIG. 4 is an enlarged cross-sectional side view illustrating the main part of the refrigerator of FIG. 1.
Figure 5:
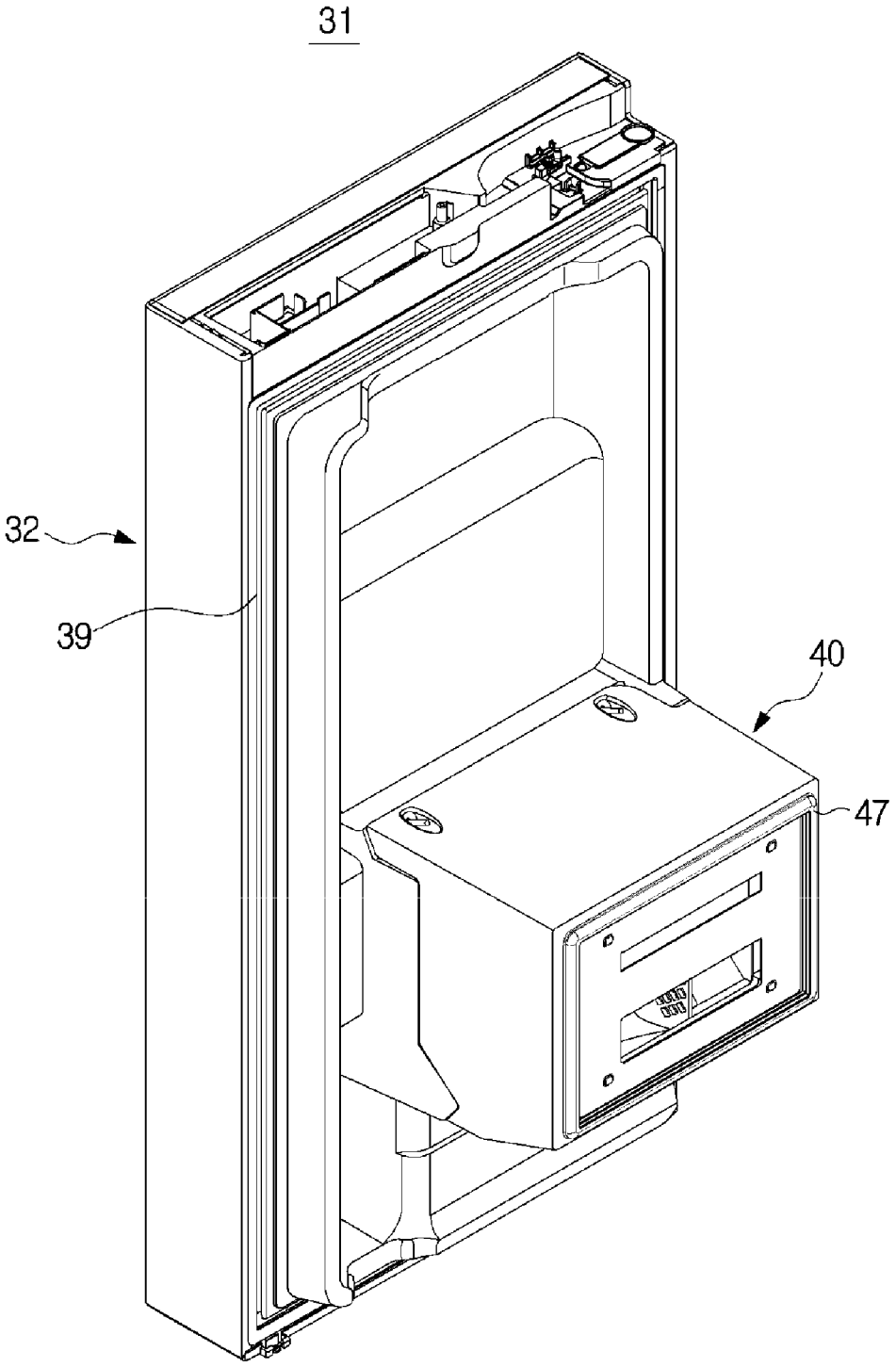
FIG. 5 is a view illustrating the door of the refrigerator of FIG. 1.
Figure 6:
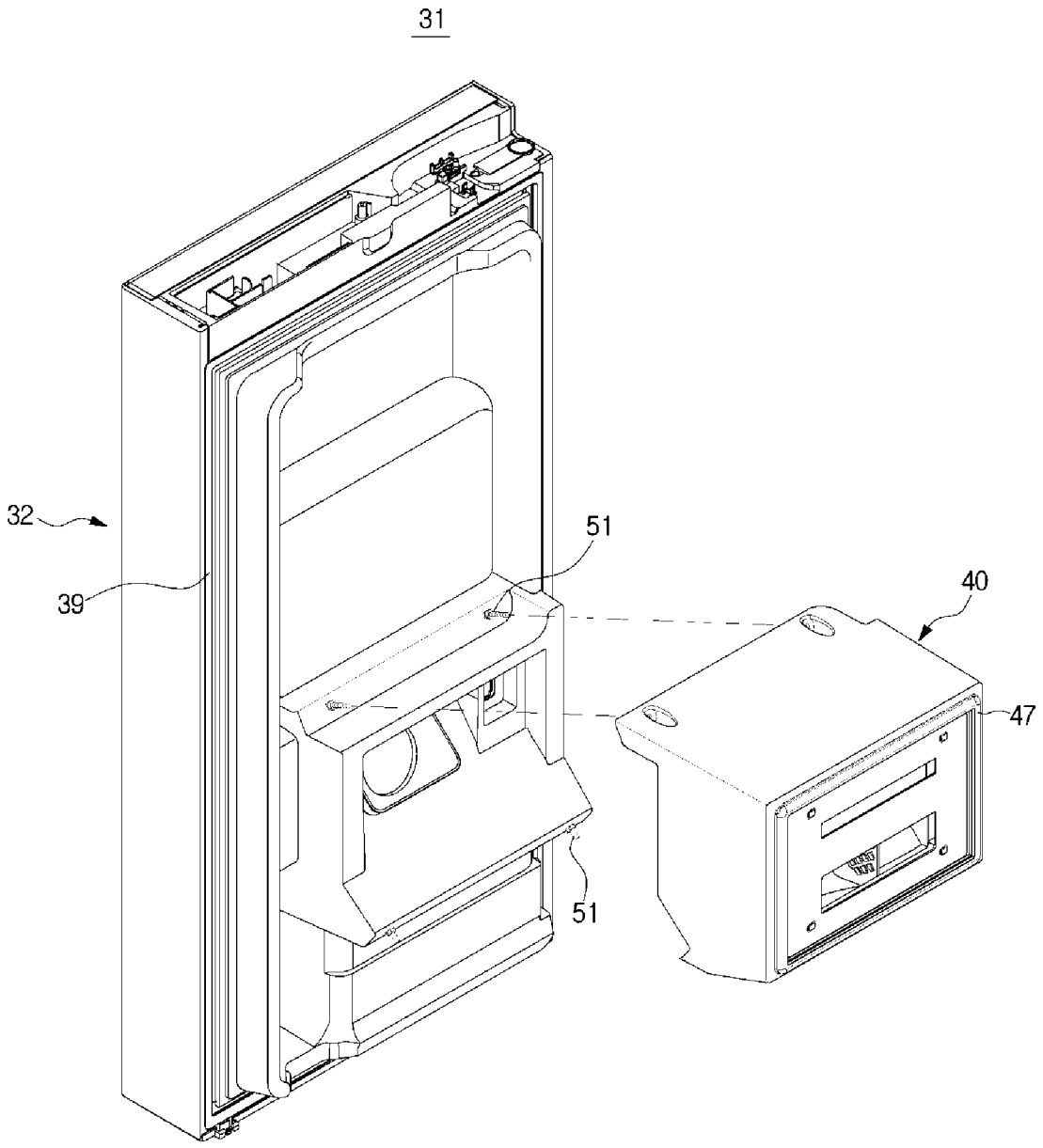
FIG. 6 is an exploded view illustrating a door body part and a second ice making housing of the refrigerator of FIG. 1.

FIG. 4 is an enlarged cross-sectional side view illustrating the main part of the refrigerator of FIG. 1. FIG. 5 is a view illustrating the door of the refrigerator of FIG. 1. FIG. 6 is an exploded view illustrating a door body part and a second ice making housing of the refrigerator of FIG. 1.

Referring to FIGS. 4 to 6, the first ice making compartment 23 and the second ice making compartment 24 of the refrigerator according to the embodiment of the disclosure will be described in detail.

The first ice making compartment 23 is a space that is provided to perform a function of generating and storing ice, and the second ice making compartment 24 is a space that is provided to perform a function of crushing the ice generated in the first ice making compartment 23.

The first ice making compartment 23 is provided in the main body 10 so as to be partitioned from the storage compartment 21, and the second ice making compartment 24 is provided in the door 31. The first ice making compartment 23 and the second ice compartment 24 are provided so as to communicate with each other when the door 31 is closed.

The first ice making compartment 23 and the second ice making compartment 24 are sealed by a second sealing member 47 which will be described later in a state in which the door 31 is closed, so the cold air in the first and second ice compartments 23 and 24 may be prevented from being released.

According to the embodiment, the first ice making compartment 23 and the second ice making compartment 24 are provided at substantially lower portions of the storage compartment 21 and the door 31, respectively. However, the positions of the first ice making compartment 23 and the second ice making compartment 24 are not limited thereto.

The door 31 may include a door body part 32 provided to open and close the storage compartment 21 and a second ice making housing 40 having the second ice making compartment 24 formed therein.

The door body part 32 and the second ice making housing 40 may be separately provided and coupled to each other. The door body part 32 and the second ice making housing 40 may be coupled to each other via a fixer member 51 (see FIG. 6). The coupling structure of the door body part 32 and the second ice making housing 40 will be described later in detail. Unlike the embodiment, the door body part 32 and the second ice making housing 40 may be integrally formed with each other.

The door body part 32 may include a case 33 and a heat insulation 34 provided inside the case 33.

The door body part 32 may include a dispenser 38 for providing ice to the outside. The dispenser 38 may include a dispensing space 38*b* on which a container, such as a cup, is placed to receive ice, a chute 38*a* for guiding the ice of the second ice making compartment 24 to the dispensing space 38*b*, and an opening and closing member 38*c* for opening and closing the chute 38*a* to prevent cold air of the second ice making compartment 24 from being released through the chute 38*a*.

The door body part 32 may include a first sealing member 39 that comes in close contact with the main body 10 when the door 31 is closed to seal the storage compartment 21. The first sealing member 39 may be formed of rubber.

The second ice making housing 40 has a second ice making compartment 24 formed therein and may include a case 41 and a heat insulation 42 provided inside the case 41.

The second ice making housing 40 may include a second sealing member 40 that comes into close contact with a first ice making housing 70, which will be described later, when the door 31 is closed to seal the first ice making compartment 23 and the second ice making compartment 24. The second sealing member 47 may be formed of rubber.

As such, the second ice making housing 40 serves not only to form the second ice making compartment 24, but also to close the first ice making compartment 23. Accordingly, the second ice making housing 40 may be referred to as an ice making compartment door part that is provided to open and close the first ice making compartment 23. Also, the door 31 may include a door body part 32 provided to open and close the storage compartment 21 and an ice making compartment door part provided to open and close the first ice making compartment 23.

The second ice making housing 40 may be coupled to the door body part 32 so as to protrude from the door body part 32 to the inside of the main body 10 when the door 31 is closed.

Accordingly, when the door 31 is closed, a distance between the rear wall 18 of the main body 10 and a portion where the second ice-making housing 40 makes contact with the first ice making housing 70 is smaller than a distance between the rear wall 18 of the main body 10 and a portion where the door body part 32 makes contact with the main body 10.

In other respects, the position of the second sealing member 47 may be closer to the rear wall 18 of the main body 10 than the position of the first sealing member 39 when the door 31 is closed.

The second ice making compartment 24 may be provided with a crushing device 90 capable of crushing ice. The crushing device 90 may include a fixed blade 91, a rotating blade 92 rotatably provided to crush ice together with the fixed blade 91, and a crushing motor 94 provided to provide a rotating force to the rotating blade 92. The rotating blade 92 may rotate around a rotating shaft 93. The rotating blade 92 may be inclined so that the ice of the second ice making compartment 24 is transferred upward when the rotating blade 92 rotates.

The crushing motor 94 may provide a clockwise and counterclockwise rotational force to the rotating blade 92 so that the rotating blade 92 may rotate clockwise and counterclockwise. The crushing device 90 may be provided to crush or not crush ice according to the rotating direction of the rotating blade 92.

The second ice making housing 40 may have an ice discharge opening 46 for discharging the ice of the second ice making compartment 24 to the dispenser 38. As described above, the rotating blade 92 is inclinedly disposed so that the ice is transferred upward from the second ice making compartment 24 so that the height of the ice discharge opening 46 may be set to be higher than a bottom 83 of the ice bucket 82.

According to the embodiment, since the first ice making compartment 23 is located in a substantially lower portion of the storage compartment 21 in the storage compartment 21 when the height of the ice discharge opening 46 is lower than or equal to the bottom 83 of the ice bucket 82, the position of the dispenser 38 may be significantly low to be inconveniently used. The structure for moving the ice of the crushing device 90 upward is intended to prevent such an inconvenience.

The refrigerator 1 may include a first ice making housing 70 coupled to the main body 10 to form the first ice making compartment 23. The first ice making housing 70 may include a case 71 and a heat insulation 72 provided inside the case 71.

The first ice making compartment 23 may be formed in the first ice making housing 70, and an ice tray 81 for generating ice by receiving water and an ice bucket 82 for storing ice may be disposed in the first ice making compartment 23.

The ice making tray 81 may produce ice in an indirect cooling method in which water is frozen by cold air of the ice making compartments 23 and 24 or a direct cooling method in which water is frozen by receiving a cooling energy by coming a refrigerant pipe into contact with the ice making tray 81.

The ice bucket 82 is disposed at a lower side of the ice making tray 81 to receive ice falling from the ice making tray 81, and may have an opened upper surface.

The ice bucket 82 may include a bottom 83 and at least one sidewall 84 (see FIG. 9) extending upwardly from the bottom 83 to form an ice storage space. An ice through hole 85 to discharge the ice of the ice bucket 82 may be formed in a sidewall 84*a* adjacent to the second ice making compartment 24 when the door 31 is closed, of the at least one side wall 84.

The refrigerator 1 may include a transfer device 86 adapted to transfer the ice of the first ice making compartment 23 to the second ice making compartment 24. The transfer device 86 is operable when the door 31 is closed so that the ice stored in the ice bucket 82 may be transferred to the second ice making compartment 24. The transfer device 86 may be disposed in the first ice making compartment 23. The transfer device 86 may include a spiral auger 87 and a transfer motor 88 that provides a rotational force to the auger 87.

With the above structure, the structure of an ice bucket is simplified and the constructing of an ice making system may be facilitated, compared to a structure in which an ice tray and an ice bucket are disposed in one ice making compartment and a crushing device is provided in the ice bucket.

Figure 7:
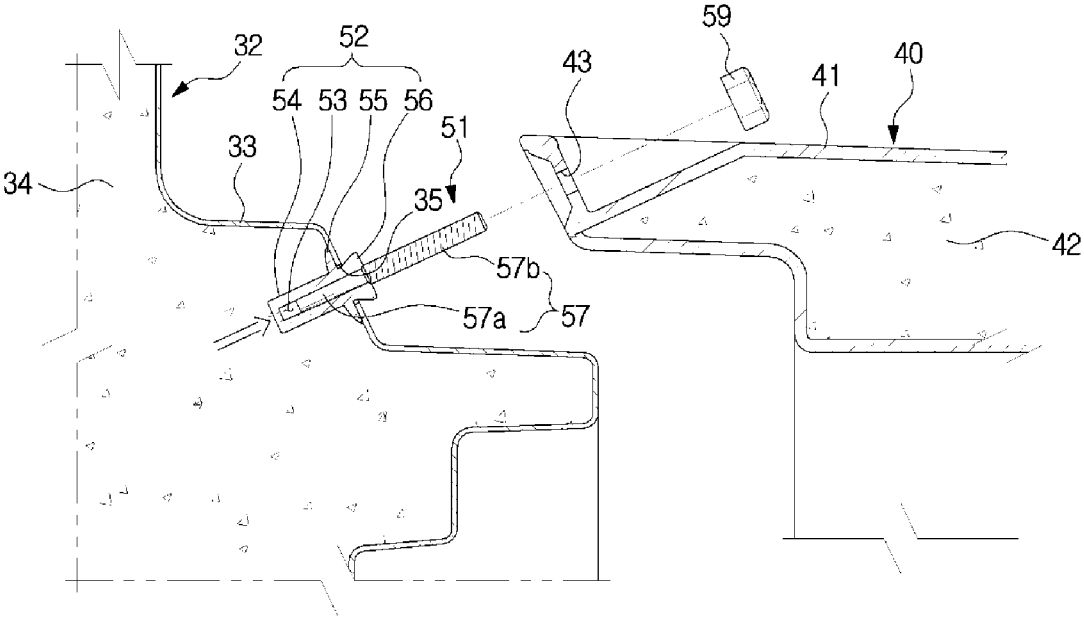
FIG. 7 is a cross-sectional view illustrating a coupling structure of the door body part and the second ice making housing of the refrigerator of FIG. 1.
Figure 8:
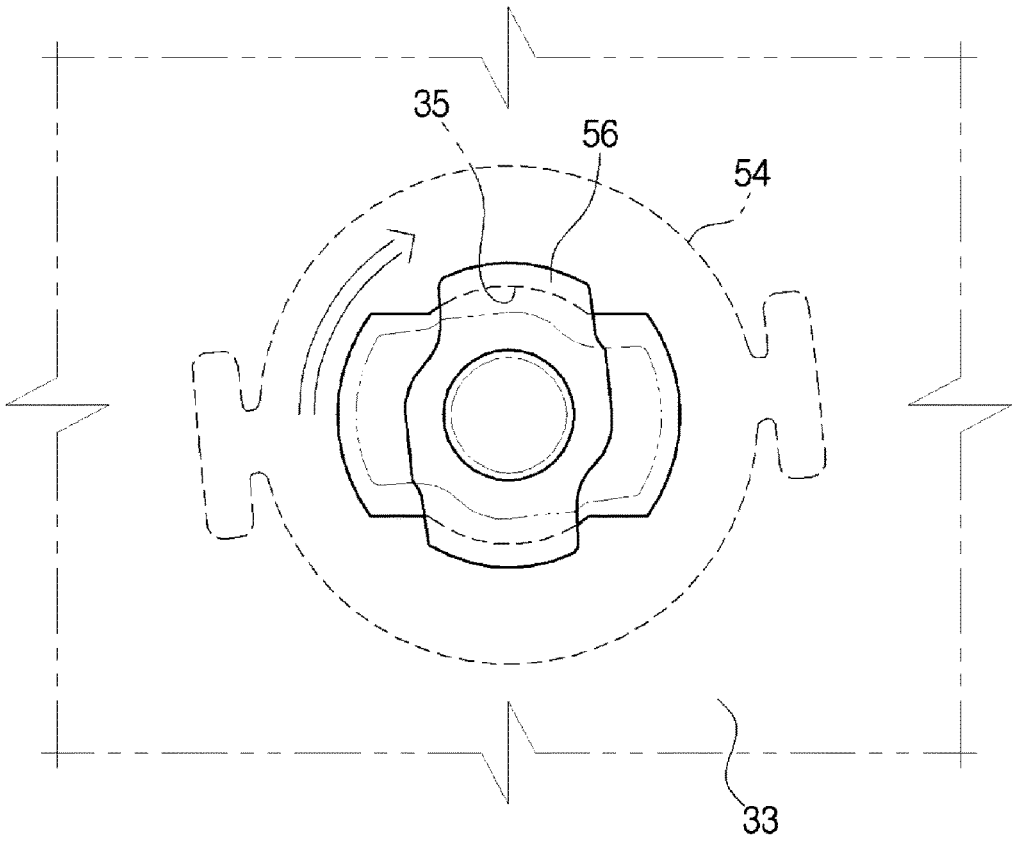
FIG. 8 is a view illustrating a process of installing a first fixer member on the door body of the refrigerator of FIG. 1.

FIG. 7 is a cross-sectional view illustrating a coupling structure of the door body part and the second ice making housing of the refrigerator of FIG. 1. FIG. 8 is a view illustrating a process of installing the first fixer member on the door body of the refrigerator of FIG. 1.

Referring to FIGS. 7 and 8, a coupling structure of the door body part 32 and the second ice making housing 40 through fixer members 51 and 59 is be described.

The fixer members 51 and 59 for coupling the door body part 32 to the second ice making housing 40 may include a first fixer member 51 fixed to the door body part 32 and a second fixer member 59 coupled to the first fixer member 51.

A coupling hole 35 may be formed in the case 33 of the door body part 32. The first fixer member 51 may pass through the coupling hole 35 and may be supported and fixed by the heat insulation 34 of the door body part 32.

The first fixer member 51 may include a first part 52 and a second part 57. The first part 52 may be formed of plastic and the second part 57 may be formed of metal. The first fixer member 51 may be injection molded by inserting the second part 57 or by press-fitting the second part 57 into the first part 52.

The first part 52 may include a fixer body part 54 having a hollow 53 for receiving the second part 57, an inner support part 55 extending radially outward from the fixer body part 54 so as to be supported on an inner surface of the case 33, and an outer support part 56 extending radially outward from the fixer body part 54 to be supported on an outer surface of the case 33.

The second part 57 may include an insertion part 57*a* received in the hollow 53 of the first part 52 and a coupling part 57*b* exposed to the outside so as to be engaged with the second fixer member 59. A male screw portion may be formed on an outer circumferential surface of the coupling part 57*b*, and a female screw portion may be formed on an inner circumferential surface of the second fixer member 59. Therefore, the first fixer member 51 and the second pick member 59 may be screwed together.

As shown in FIG. 8, the coupling hole 35 formed in the case 33 has a shape of a slot rather than a circle, and the outer support part 56 of the first fixer member 51 may also have a shape corresponding to the coupling hole 35 instead of a circular shape.

The process of coupling the door body part 32 to the second ice making housing 40 through the first and second fixer members 51 and 59 is as follows.

First, the first fixer member 51 is coupled to the door body part 32.

Specifically, before the heat insulation 34 is foamed inside the case 33 of the door body part 32, the first fixer member 51 is fitted in the coupling hole 35 of the case 33 from the inside to the outside of the case 33 (the direction of the arrow in FIG. 7). At this time, as shown in FIG. 8, after the shape of the outer support part 56 is adjusted to be matched with the shape of the coupling hole 35 so that the outer support part 56 passes through the coupling hole 35, the first fixer member 51 is rotated (the direction of the arrow in FIG. 8) so that the outer support part 56 does not pass through the coupling hole 35 again in the opposite direction.

Next, the heat insulation 34 is foamed inside the case 33 of the door body part 32. When the heat insulation 34 is foamed, the first fixer member 51 may be supported by the heat insulation 34 and fixed to the door body part 32.

Next, after the second ice making housing 40 is brought into close contact with the door body part 32 so that the coupling part 57*b* of the first fixer member 51 passes through the coupling hole 43 of the second ice making housing 40, the first fixer member 51 and the second fixer member 59 are screwed to each other. With this structure, the door body part 32 and the second ice making housing 40 may be easily and firmly coupled to each other.

Figure 9:
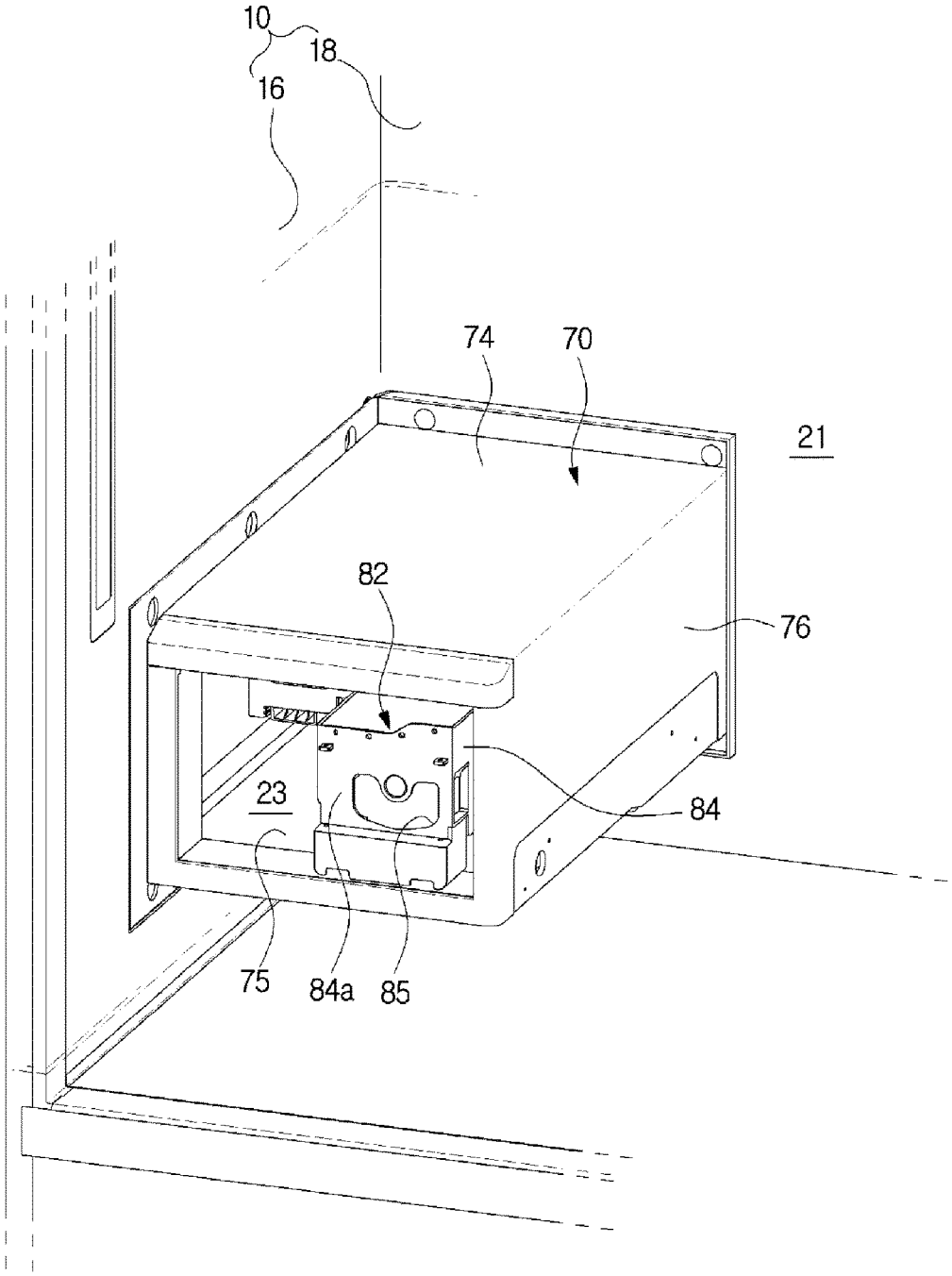
FIG. 9 is a view illustrating a first ice making housing of the refrigerator of FIG. 1.
Figure 10:
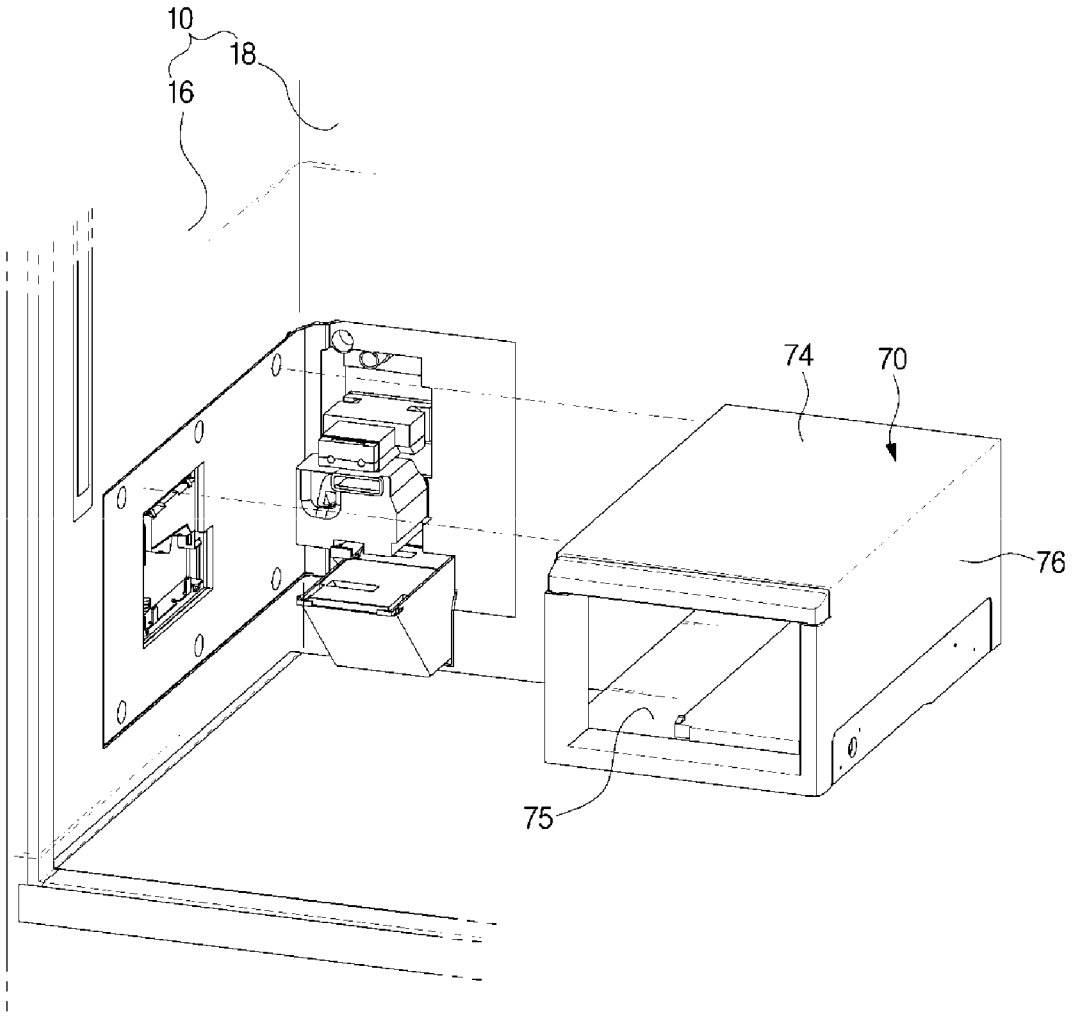
FIG. 10 is a view illustrating the first ice making housing separated from the main body of the refrigerator of FIG. 1.

FIG. 9 is a view illustrating the first ice making housing of the refrigerator of FIG. 1. FIG. 10 is a view illustrating the first ice making housing separated from the main body of the refrigerator of FIG. 1.

Referring to FIGS. 9 and 10, a coupling structure of the first ice making housing and the main body of the refrigerator according to an embodiment of the disclosure is described.

The first ice making housing 70 may be provided separately from the main body 10 and may be coupled to the main body 10. The first ice making housing 70 may be coupled to the first sidewall 16 and the rear wall 18 of the body 10.

The first ice making housing 70 may include a housing upper wall 74 forming an upper surface of the first ice making compartment 23, a housing lower wall 75 forming a lower surface of the first ice making compartment 23, and a sidewall 76 of the housing forming one of side surfaces of the ice making compartment 23. The remaining of the side surfaces of the first ice making compartment 23 may be formed by the main body 10.

Since the first ice making compartment 70 is formed by coupling the first ice making housing 70 to the main body 10 as described above, the first ice making compartment 23 is easily constructed and the position of the first ice making compartment 23 may be designed variously.

Figure 11:
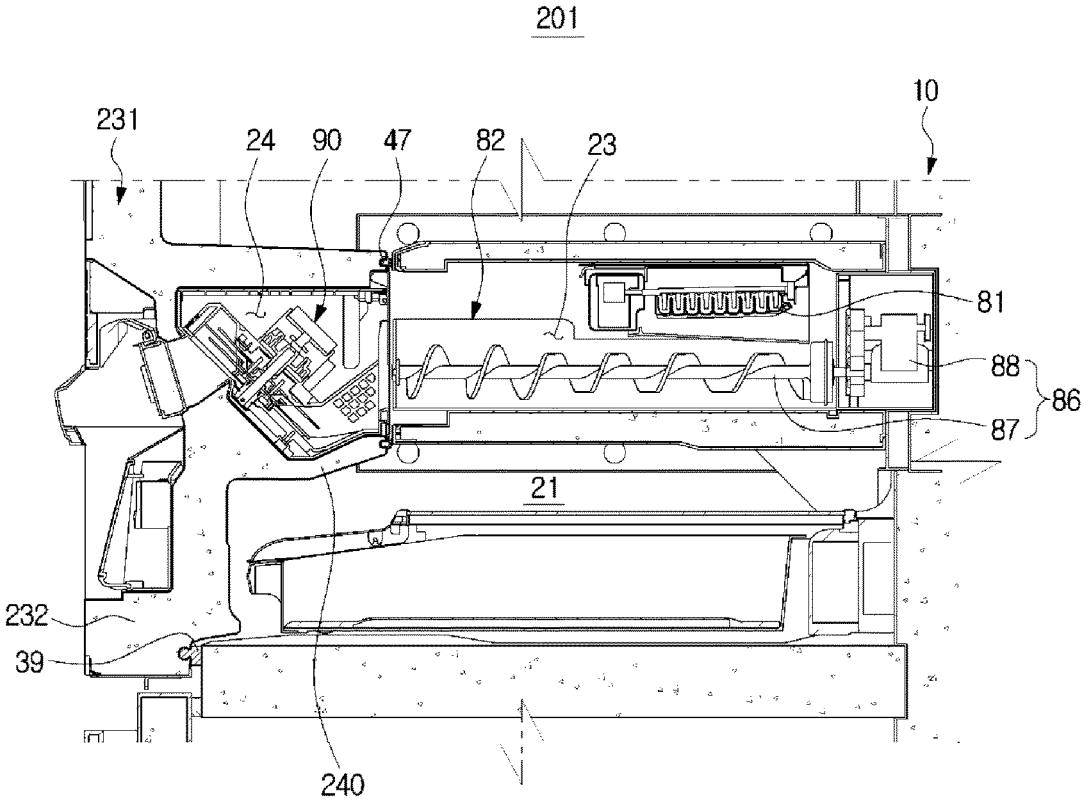
FIG. 11 is a side cross-sectional view illustrating a main part of a refrigerator according to an embodiment of the disclosure.

FIG. 11 is a side cross-sectional view illustrating a main part of a refrigerator according to an embodiment of the disclosure.

Referring to FIG. 11, a refrigerator according to an embodiment of the disclosure is described. The same reference numerals are given to the same components as those of the above-described embodiment, and description thereof may be omitted.

The first ice making compartment 23 is partitioned from the storage compartment 21 in the main body 10, and the second ice making compartment 24 is provided in the door 231. The first ice making compartment 23 and the second ice making compartment 24 are provided to communicate with each other when the door 231 is closed. The door 231 may include a door body part 232 provided to open and close the storage compartment 21 and a second ice making housing 240 having a second ice making compartment 24 formed therein.

Unlike the above-described embodiment, the door body part 232 and the second ice making housing 240 may be integrally formed with each other. When the door body part 232 and the second ice making housing 240 are separately provided and assembled to each other, a foaming process needs to be performed on each of the door body part 232 and the second ice making housing 240, but according to the embodiment, the door body part 232 and the second ice making housing 240 are integrally formed with each other, so that only a single foaming process is performed.

The second ice making housing may be provided to protrude from the door body part 232 to the inside of the main body 10 when the door 231 is closed.

The door 231 may include a first sealing member for sealing the storage compartment 21 and a second sealing member 47 for sealing the first ice making compartment 23 and the second ice making compartment 24. The first ice making compartment 23 may be provided with an ice making tray 81 for storing water and producing ice and an ice bucket 82 for storing ice. The first ice making compartment 23 may be provided with a transfer device 86 for transferring the ice of the first ice making compartment 23 to the second ice making compartment 24. The transfer device 86 may include a spiral auger 87 rotatably provided and a transfer motor 88 providing a rotational force to the spiral auger 87. The second ice making compartment 24 may be provided with a crushing device 90 capable of crushing ice.

Figure 12:
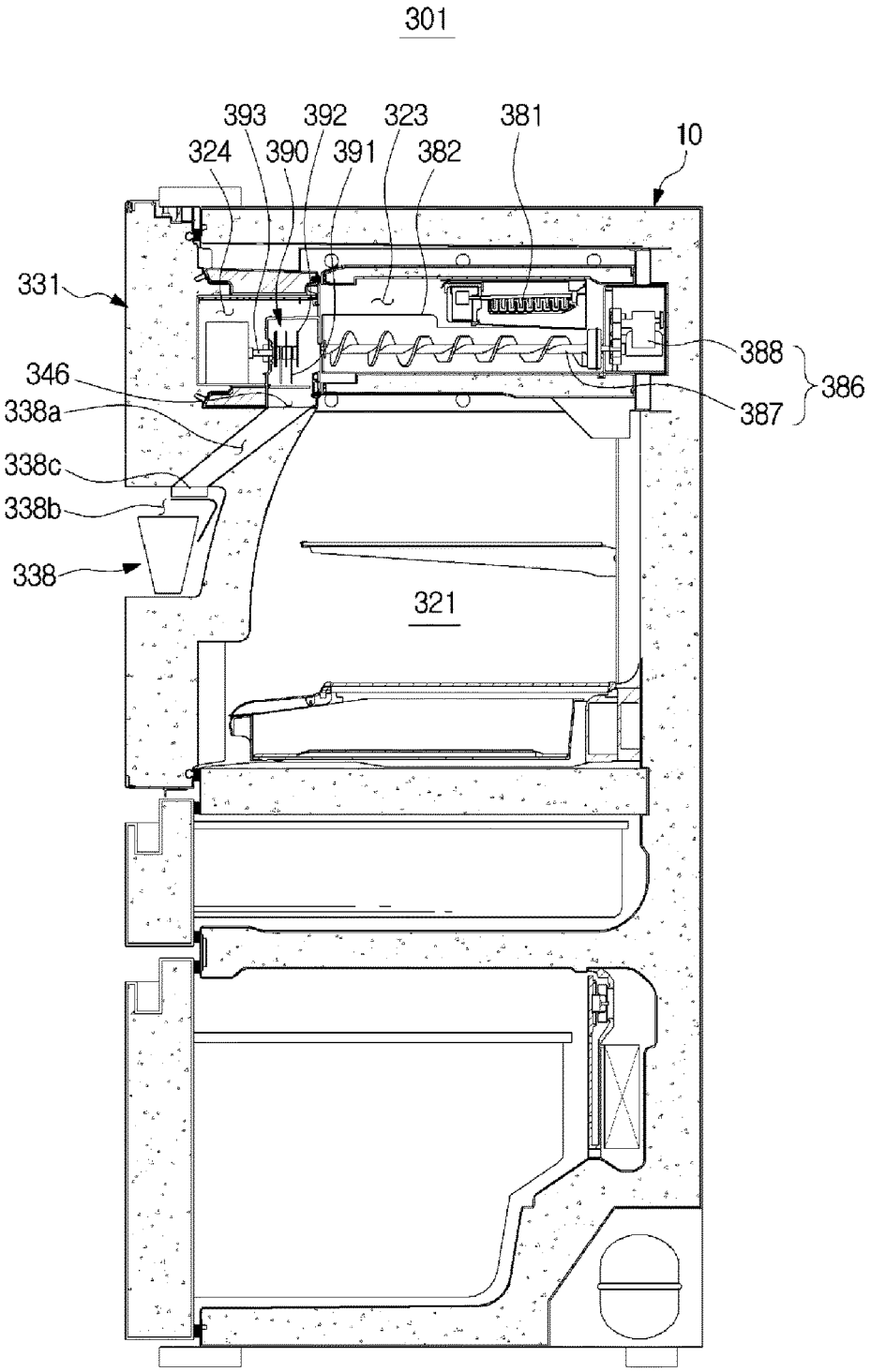
FIG. 12 is a side sectional view schematically illustrating a refrigerator according to an embodiment of the disclosure.

FIG. 12 is a side sectional view schematically illustrating a refrigerator according to an embodiment of the disclosure.

Referring to FIG. 12, a refrigerator according to an embodiment of the disclosure will be described. The same reference numerals are assigned to the same components as those of the above-described embodiments, and description thereof may be omitted.

A first ice making compartment 323 is partitioned from a storage compartment 321 in the main body 10 and a second ice making compartment 324 is provided in a door 331. The first ice making compartment 323 and the second ice making compartment 324 are provided so as to communicate with each other when the door 331 is closed. Unlike the above-described embodiment, the first ice making compartment 323 may be formed in the upper part of the inside of the storage compartment 321.

The door 331 may include a dispenser 338 for providing ice to the outside. The dispenser 338 may include a dispensing space 338*b* on which a container, such as a cup, is placed to receive ice, a chute 338*a* for guiding the ice of the second ice making compartment 324 to the dispensing space 338*b*, and an opening and closing member 338*c* for opening and closing the chute 338*a* to prevent cold air in the second ice making compartment 324 from being released through the chute 338*a*.

The first ice making compartment 323 may be provided with an ice tray 381 for storing water and producing ice, and an ice bucket 382 for storing ice. The first ice making compartment 323 may be provided with a transfer device 386 for transferring the ice of the first ice making compartment 323 to the second ice making compartment 324. The transfer device 386 may include a spiral auger 387 rotatably provided and a transfer motor 388 for providing a rotational force to the spiral auger 387.

The second ice making compartment 324 may be provided with a crushing device 390 capable of crushing ice. The crushing device 390 may include a fixed blade 391, a rotating blade 392 rotatably provided to crush ice together with the fixed blade 391, a crushing motor provided to provide a rotating force to the rotating blade 392. The rotating blade 392 may rotate around a rotating shaft 393.

The second ice making housing may have an ice discharge opening 346 for discharging the ice of the second ice making compartment 324 to the dispenser 338.

Since the first ice making compartment 323 is formed in the upper part of the inside of the storage compartment 321, a structure in which the ice of the ice bucket 382 is moved upward such that the ice is discharged, that is, an inclined structure of the rotating blade 392 is not needed. The ice discharge opening 346 may be formed at a position lower than or equal to a position of the bottom of the ice bucket 382.

As is apparent from the above description, since the crushing device for crushing ice is provided on the door that opens and closes the main body, the structure of the ice bucket is simplified and the ice making system can be easily constructed, compared to the conventional structure in which a crushing device is provided in an ice bucket.

Since the ice making compartment door for opening and closing the ice making compartment is provided in the storage compartment door for opening and closing the main body, the structure of the ice bucket can be simplified and the ice making system can be easily constructed compared to the conventional structure in which an ice making compartment door is provided in an ice bucket.

Although example embodiments of the disclosure have been shown and described, it would be appreciated by those skilled in the art that changes may be made to these embodiments without departing from the principles and spirit of the disclosure, the scope of which is defined in the claims and their equivalents.

What is claimed is:

1. A refrigerator, comprising:

a main body;

a storage compartment provided in the main body;

a door rotatably coupled to the main body;

a first ice making compartment configured to generate and store ice, and provided in the main body;

a second ice making compartment provided in the door and configured to crush ice by a crushing device, disposed in the second ice making compartment; and a transfer device configured to transfer the ice in the first ice making compartment to the second ice making compartment;

wherein the crushing device is disposed to be inclined such that the ice of the second ice making compartment is transferred upward.

2. The refrigerator according to claim 1, wherein when the door is closed, the first ice making compartment and the second ice making compartment communicate with each other.

3. The refrigerator according to claim 1, wherein the door comprises a door body part provided to open and close the storage compartment and a second ice making housing in which the second ice making compartment is disposed.

4. The refrigerator according to claim 3, wherein the second ice making housing protrudes from the door body part toward an inside of the main body when the door is closed.

5. The refrigerator according to claim 3, wherein the door body part and the second ice making housing are configured to be detachably removable from one another.

6. The refrigerator according to claim 5, wherein the door comprises a fixer member configured to couple the door body part to the second ice making housing.

7. The refrigerator according to claim 6, wherein the door body part comprises heat insulation, and the fixer member is supported and fixed by the heat insulation.

8. The refrigerator according to claim 3, wherein the door body part and the second ice making housing are integrally formed with each other.

9. The refrigerator according to claim 3, wherein the second ice making housing comprises heat insulation provided to thermally insulate the second ice making compartment.

10. The refrigerator according to claim 1, wherein the first ice making compartment comprises a first ice making housing coupled to the main body, the first ice making housing including:

a housing upper wall corresponding to an upper surface of the first ice making compartment;

a lower housing wall corresponding to a lower surface of the first ice making compartment; and a housing sidewall corresponding to a side surface of the first ice making compartment.

11. The refrigerator according to claim 1, further comprising:

an ice making tray, disposed in the first ice making compartment, configured to store water to produce the ice; and an ice bucket, disposed in the first ice making compartment, configured to store the ice.

12. The refrigerator according to claim 11, wherein the ice bucket comprises a bottom and at least one sidewall extending upwardly from the bottom to form an ice storage space, and a sidewall among the at least one sidewall of the ice bucket is disposed adjacent to the second ice making compartment when the door is closed and comprises an ice through-hole through which ice of the ice bucket is discharged.

13. The refrigerator according to claim 1, wherein the crushing device comprises a fixed blade, a rotating blade rotatably provided to crush the ice together with the fixed blade, and a crushing motor configured to provide rotational force to the rotating blade.

* * * * *